United States Patent [19]

Von Schuckmann

[11] 4,099,697

[45] Jul. 11, 1978

[54] TILTING POST SUPPORTED SEAT BIASED TO AN UPRIGHT POSITION

[76] Inventor: Alfred Von Schuckmann, Nordstr. 32a, Haan, Germany, 5657

[21] Appl. No.: 728,541

[22] Filed: Oct. 1, 1976

[30] Foreign Application Priority Data

Oct. 2, 1975 [DE] Fed. Rep. of Germany .... 7531129[]
Sep. 18, 1976 [DE] Fed. Rep. of Germany ..... 2642112

[51] Int. Cl.[2] ..... A47C 3/18

[52] U.S. Cl. ..... 248/385; 248/398; 297/314

[58] Field of Search ..... 297/314; 248/398, 385, 248/401, 372, 417, 418, 415, 416, 382; 108/2

[56] References Cited

U.S. PATENT DOCUMENTS

| | | | |
|---|---|---|---|
| 612,580 | 10/1898 | Banes | 108/2 |
| 619,596 | 2/1899 | Mayer | 248/398 |
| 849,975 | 4/1907 | Carlson | 248/401 X |
| 1,067,961 | 7/1913 | Bailey | 248/401 |
| 1,194,551 | 8/1916 | Schossler | 248/371 X |
| 1,961,530 | 6/1934 | Spanenberg | 297/314 X |
| 2,291,975 | 8/1942 | Minero | 248/418 |
| 3,713,618 | 1/1973 | Hendrickson et al. | 248/417 |

*Primary Examiner*—Francis K. Zugel
*Attorney, Agent, or Firm*—Montague & Ross

[57] ABSTRACT

A stool-like seat for limited mobility of the user with a high action radius comprises a base formed with a ball socket and a post carrying the seating surface and provided with a ball receivable in the socket. The post has a downwardly extending member engaging, within the base, a star-like array of tension springs which resist angular displacement of the post and bias the latter into a normal upright position.

11 Claims, 5 Drawing Figures

TILTING POST SUPPORTED SEAT BIASED TO AN UPRIGHT POSITION

FIELD OF THE INVENTION

The present invention relates to a stool-like seat with a high action radius and, more particularly, to a seat for vehicle drivers, draftsmen, cashiers or other individuals requiring a high degree of mobility and adapted to be used in cases in which rolling chairs are not satisfactory.

BACKGROUND OF THE INVENTION

It has been proposed heretofore to provide rolling chairs and the like, swivel chairs, stools with seating surfaces rotatable on the base and like seating arrangements for individuals requiring a high action radius. In some cases a rolling of the chair on a floor surface is not satisfactory, e.g. in an automotive vehicle, and simple pivoting movement of the seating surface provides insufficient mobility to allow the individual using the seat to reach various locations as required.

OBJECTS OF THE INVENTION

It is an object of the invention to provide a stool-type seat which avoids the aforementioned disadvantages and has a significant and practically universal relatively high action radius.

It is also an object of the invention to provide a simply manufactured, highly versatile seat which is both stable and mobile in all directions.

It is yet another object of the invention to provide a seat with a high action radius having a fixed location for its base.

SUMMARY OF THE INVENTION

These objects and others which will become hereinafter more readily apparent are attained, in accordance with the invention, in a stool-type seat which comprises a base formed with a ball socket and a post having a ball received in this socket for universal movement, i.e. movement with at least two degrees of freedom to permit tilting of the post in all directions, the post on the ball carrying the seating surface. According to the invention, below the ball there is provided a star-like array of generally radial tension springs, i.e. coil springs, which bias the post into a normal generally upright position and yieldably resist deflection of the post out of its normal position in all directions with progressively increasing force.

According to a feature of the invention, the angular displacement of the post relative to the base of the seat is limited by abutments provided beneath the ball joint. Advantageously, the ball socket is provided with quarter-circular segmental abutment ribs which simultaneously reinforce the socket wall and provide the abutments mentioned previously. To this end, the post can be provided below the ball joint with a stem having a transverse pin which is engageable with these ribs to limit rotation of the post about its generally upright axis.

According to still another feature of the invention, the stem is bent at an obtuse angle to the axis of the post approximately at the level of the abutment pin so that the springs are attached to the stem at a location substantially in line (i.e. in the same vertical plane in the normal position of the post) with the pivot axis of the ball joint.

The socket can be formed with a throughgoing bore through which the stem passes with play. Most advantageously, the fitting surface is constituted by a bucket seat mounted upon the upper end of the post.

To permit removal of the post and the stem attached thereto or insertion thereof into the base, the socket can be provided, in line with the transverse pin, with a pair of slots opening into the throughgoing bore of the socket. The springs can engage a disk which can be releasably mounted upon the lower end of the stem, preferably via a washer and a screw.

The other extremities, i.e. outer extremities, of the springs can be anchored in brackets which are held nonrotatably in channels formed in the base and which can be adjustably connected thereto by a bolt arrangement. Tightening of the bolt can tension the springs. The brackets can be guided by shoulders formed unitarily on the base and preferably on the lateral walls of the aforementioned channels.

As a result of this structure, the post can be swiveled and tilted practically in all directions to make for a large action radius of the bucket seat. The star-like array of springs constitutes a restoring mechanism which resists the tilting and swiveling movements of the post with increasing resistance in all directions and restores the post and the seat to its normal or central position. For convenience in use, it has been found desirable to limit rotation of the seating surface about the axis of the post to an angle of about 90°, thereby eliminating the possibility, in an extreme tilted position of the post, of uncontrolled rotation tending to spill the user. The abutment means for limiting the rotation as described are simply constructed and are concealed in the base.

The abutment pin projects diametrically in both directions from the stem and the projecting portions of the pin have lengths such that they engage the quarter segments formed as ribs of the base.

The angular arrangement of the stem has been found to be advantageous since it serves to establish a slight forward tilt of the post which facilitates mounting of the seat and dismounting therefrom while affording maximum direct force transmission in line with the post to the base in the seating position most often desired.

The tilting movements of the post are limited by the edges of the throughgoing bore of the socket which receives, as noted, the stem with limited play. Since the stem has a cross section which is smaller than the cross section of the throughgoing bore, where at the contact regions is minimized. The aforementioned slots, moreover, clear the pin so that, when the post and the stem are swung about an axis perpendicular to the pin but in the plane thereof, the pin does not engage the bottom of the socket to limit this swinging movement. The pin, which would otherwise tend to wear excessively, thus serves only as an abutment preventing rotation of the post about its axis and the axis of the stem.

To remove the post, as also has been noted earlier, it is merely necessary to detach the means anchoring the spring disk to the stem, whereupon the entire post and ball assembly can be lifted from the base. The spring tension can be adjusted by the bolt means anchoring the outer extremities of the springs to the base.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
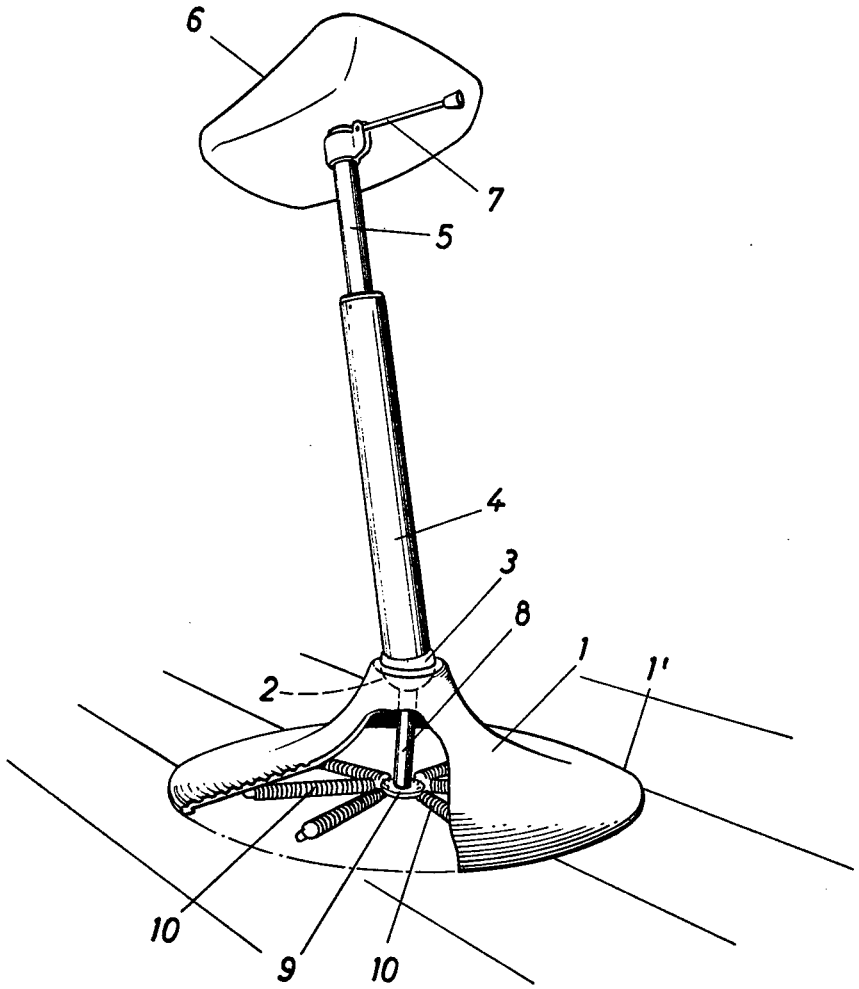
FIG. 1 is a perspective view of the stool-type seat of the present invention, partly broken away at the base.

The seat illustrated in the drawing comprises a substantially rotationally symmetrical, centrally raised hollow base 1 of frustoconical configuration and cast in a single piece. The outer diameter of the base is such as to lie outside the center of gravity of the user of the seat in all possible positions of the post and the base can be of sufficient weight to prevent tilting of the seat unit by the user.

Figures 2, 3, 4:
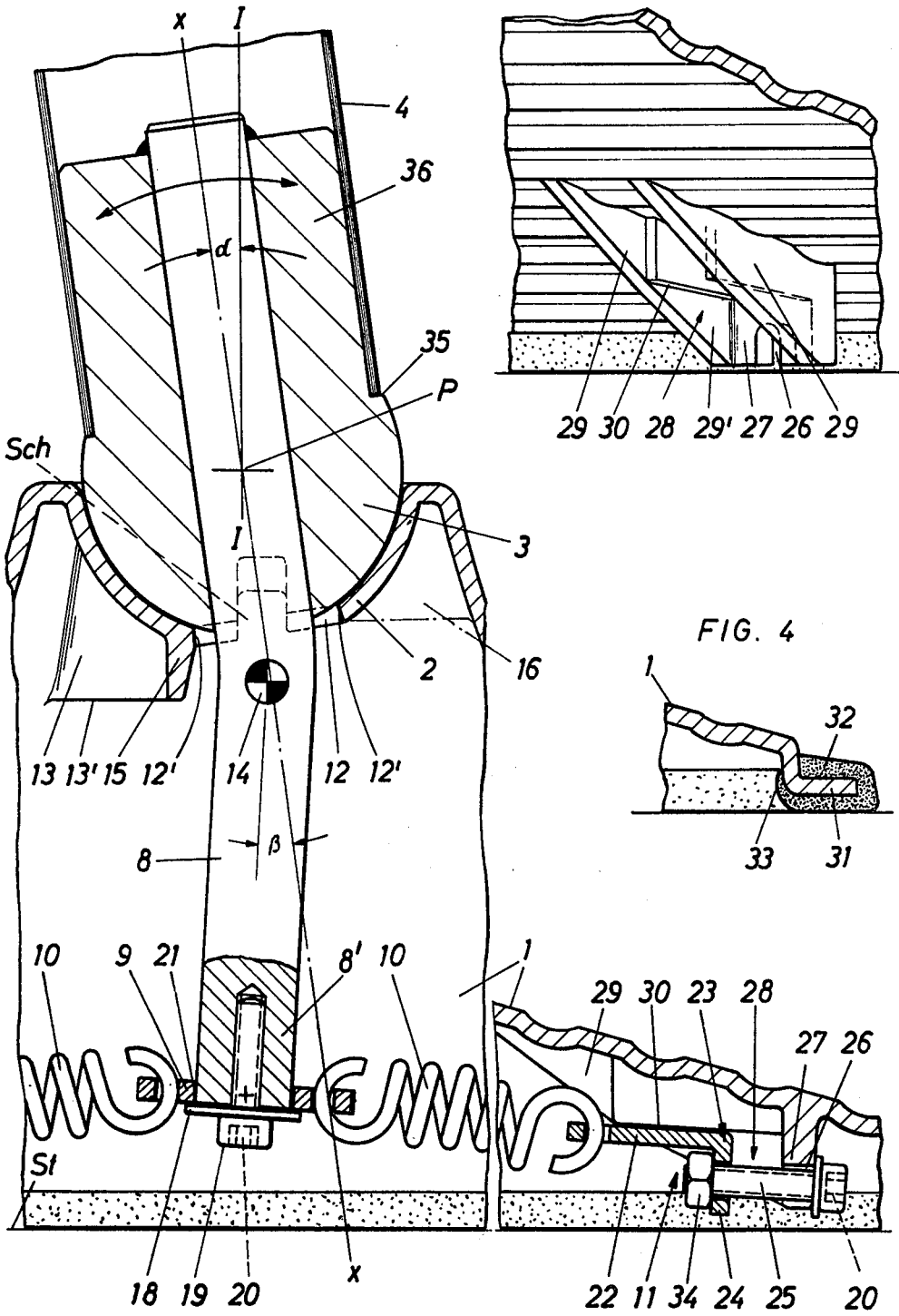
FIG. 2 is a detail view, in axial cross section, through the ball joint of the present invention shown in its normal upright position.
FIG. 3 is a detail of the underside of the base, in perspective view, showing the channels in which the brackets for the outer ends of the springs are received.
FIG. 4 is a detail cross section of the edge of the base.

At the top of the base there is provided a ball joint socket 2 in which a ball member 3 is swingably and rotatably received. Members 2 and 3 thus form the ball joint of the present invention. A post 4 of tubular construction is mounted on the ball 3 and has a slightly forward tilt, as shown in FIG. 2, in its normal generally upright position.

The tubular post 4 is provided with a nonrotatable telescopic inner member 5 which can be raised and lowered by a gas-pressure spring not shown, the telescoping part 5 carrying a bucket seat 6 via a flange providing the necessary support against torque at the junction between the member 5 and the seat. Below the bucket seat and rearwardly thereof, there is provided a handle 7 for relieving the gas pressure spring and thereby enabling the bucket seat 6 to be raised and lowered on the post 4.

The post 4 is provided, below the ball joint ⅔, with a stem 8 of substantially smaller cross section than the ball 3.

At the bottom of the stem 8, there is provided an internally threaded bore carrying a retaining disk 9 having perforations into which one end of a plurality of springs 10 is hooked. The springs 10 are disposed radially, i.e. in star-configuration, and at their opposite extremities (outer ends) are tied with tensining devices 11 to the base 1 at the region of the acute-angle flattened wall portion 1' of the latter. These springs 10 form a restoring mechanism and hold the post 4 in a predetermined normal position as shown in FIG. 2. Preferably, as is also apparent from this Figure, the normal position is tilted slightly forwardly at an angle $\alpha$ of about 10° to the vertical I — I. This facilitates mounting of the seat and dismounting therefrom. This forward tilt corresponds substantially to the normal use position of the seat 6 so that the body axis of the user normally is aligned with the longitudinal axis $x$—$x$ of the post 4. From this normal position, the post 4 can be tilted in all directions about the center P of the ball joint with a large action radius for the user. The springs 10, in all tilted positions of the post, develop a progressively increasing restoring force and tend to return the post 4 to the normal position when the user dismounts from the seat 6.

The tilting movement about the point P is limited by engagement of the stem 8 with the boundary wall 12' of a throughgoing bore 12 formed in the socket 2 and receiving the stem 8 with clearance. The abutment 12' is so dimensioned that, from the normal position, the post 4 can be tilted forwardly through about 9° and rearwardly through about 8° (see the forward-tile plane y—y in FIG. 5). The lateral tilting movement is of the same order of magnitude.

As can be seen especially from FIG. 2, the stem 8 is bent at an obtuse angle directly beneath the ball 3 so that the lower end 8' at which the springs 10 are effective lies vertically below the pivot point P of the ball joint ⅔.

The bend (angle $\beta$) corresponds approximately to 12° from the post axis x—x. As a result, the stem 8 forms a crank-like structure, upon rotation of the ball 3 about the axis x—x. Since the springs are disposed symmetrically in a star-configuration, they also resist this rotation and provide a restoring force tending to return the stem 8 to the normal position shown in spite of the fact that the ring 9 at which the springs 10 are anchored to the stem 8 is freely rotatable on the latter.

The angular displacement or rotation of the post 4 about its axis $x$—$x$ is limited by abutments formed by a pin 14 which extends diametrically through the stem and projects from opposite sides thereof prependicular to the axis x—x and to the stem 8.

Figure 5:
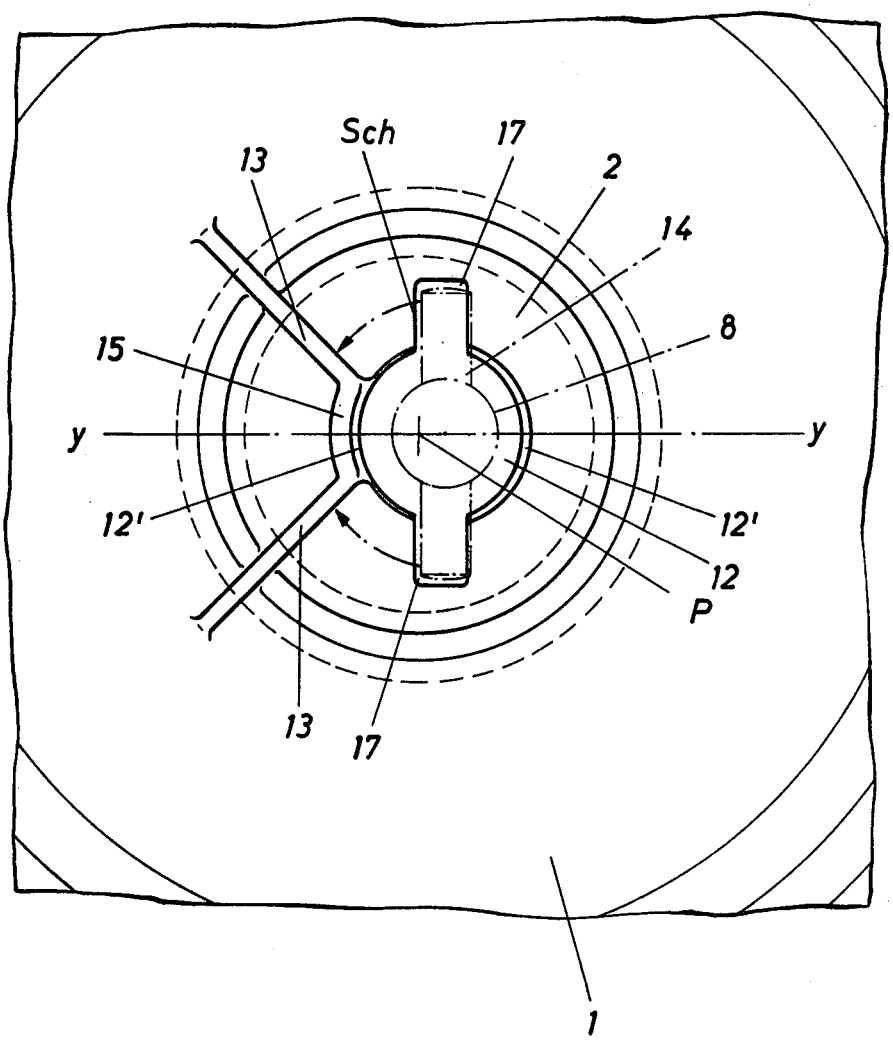
FIG. 5 is a bottom view of the ball-joint socket to show in greater detail the abutment means limiting angular displacement of the post.

More particularly, the base 1 is formed with two quarter-circular segmental abutment ribs 13 which are disposed at the level of the pin 14 and are engageable when the post 4 is rotated about its axis in either sense (see the arrows in FIG. 5). The ribs 13 also serve as reinforcing ribs for the wall of the ball socket 2. The pin 14 lies, as has been indicated, transversely to the forward tilt direction of the post 4. The ends of the pins 14 are such as to insure that they will engage the ribs 13 but are spaced therefrom sufficiently to accommodate the angular displacement indicated by the arrows in FIG. 5 through a total of, say, 90°. This has been found to be a practical limit and angular displacement through 45° is permitted to either side of the normal position.

The ribs 13 are bridged by a segment 15 lying along the wall 12' and constituting further reinforcement of this edge of the socket. The segment 15 corresponds to the contour of the bore 12 and is inclined slightly away from the vertical to accommodate the angular orientation of the stem 8.

The ribs 13 are cast unitarily with the socket 2 and the remainder of the base 1. The roller edges 13' of the ribs can lie in the same horizontal plane as the underside of the pin 14. The lower edges 13' run parallel to the supporting surface St of the base. Where the ribs 13 join the frustoconical wall of the base, they are radiused into the latter for maximum stability of the ball socket. Further stability can be afforded by radially extending ribs 16 which extend downwardly only as far as the bottom of the socket 2. The ribs 16 are also radiused into the frustoconical wall of the base.

The ball socket 2 is provided with a pair of throughgoing slots Sch which correspond in contour to the pins 14, are aligned therewith but they pass the pins 14 with clearance, the slot 14 having a pair of opposite sections 17.

The ring 9 is releasably mounted on the bottom 8' of the stem 8 by a screw 19 and a washer 18, the latter having a diameter greater than the inner diameter 21 of the ring 9. The screw 19 is threaded into the bottom of the stem and is formed with an inner hexagonal socket 20 adapted to receive an Allen key 20. Thus, once the screw 19 is removed, the stem 8, the ball 8, the post 4 and the bucket seat 6 can be lifted out of the seat 2, the pin 14 passing through the slot 14, 17.

The outer end of each spring 10 is hooked into an angle bracket 22 having a downwardly extending leg 24 traversed by a screw 25 onto which a nut 34 is threaded. The screw 25 is received within a bore 26 of a downwardly extending web 27 of the base 1, the web 27 forming an end wall of a radial channel 28 defined between a pair of triangular ribs 29 are provided with horizontal shoulders 30 parallel to the surface St, along which the shank 22 of the angle bracket 23 is guided to prevent rotation of this angle bracket. The nut 34 is hexagonal and is held against rotation by the underside of the shank 22. The head of the screw 25 can also be provided with an internal hexagonal socket 20 adapted to receive an Allen key which can be used to rotate the screw 25 and thereby tension the spring 10. The ribs 29 are formed unitarily with the wall of the base 1 and thus also serve to reinforce the latter.

The outer edge 1' of the base 1 is downwardly and outwardly bent to provide a substantially horizontal flange 31 over which a rubber profile 32 is fitted. An inwardly and upwardly extending lip 33 of this profile retains the member 32 along the flange 31 to form a cushioning mount for the support 1. The rubber profile 32 is generally of U configuration and completely encloses the flange 31.

To permit access to the screws 25 and the screw 19, the bottom of the base 1 is open.

As can be seen from FIG. 2, the ball 3 is provided with an outwardly extending shoulder 35 and with a cylindrical boss 36 over which the tubular post 4 is forced against the shoulder 35. The tubular post 4 may be held on the boss 36 by any conventional means, e.g. a set screw or clamp. As noted, approximately midway along the post 4, there is provided a gas spring whose piston may engage an abutment formed within the post 4 in accordance with conventional principles.

I claim:

1. A seat comprising:

a base member;

a post member extending generally upwardly from said base member;

a ball joint interconnecting said members for tilting movement of said post member relative to said base member;

a seating surface formed on said post; and a star-like array of tension springs engaging said post member and anchored to said base member for resisting tilting movements of said post member and biasing same into a normal generally upright position, said base member comprising a hollow support formed with a ball joint socket, said post member comprising a tubular post having a ball received in said socket and a stem extending below said ball beneath said socket, said socket having a throughgoing bore traversed with clearance by said stem, said springs engaging said stem below said socket, said stem being bent at an obtuse angle below said socket and having a lower end engaged by said springs and disposed substantially vertically below the pivot of said ball joint whereby said springs bias said seating surface into a forwardly tilted normal position.

2. The seat defined in claim 1 wherein said post member is rotatable about a generally upright axis relative to said base member, said seat further comprising abutment means on said members limiting rotation of said post member about said axis.

3. The seat defined in claim 2 wherein said abutment means includes a pin carried by and extending transversely to said stem and a pair of quarter-circular segments formed on said support and engageable by said pin upon rotation of said post about said axis.

4. The seat defined in claim 3 wherein said bore has an edge forming an abutment engageable by said stem and limiting the pivotal movement of said ball in said socket.

5. The seat defined in claim 4 wherein said seating surface is formed as a bucket seat.

6. The seat defined in claim 4 wherein said socket is formed with a slot adapted to clear said pin upon withdrawal of said ball from said socket, said seat further comprising a retaining disk detachably mounted on said lower end of said stem and engaged by one end of each of said springs, said springs extending radially from said disk outwardly toward said support.

7. The seat defined in claim 6 wherein said disk is releasably retained on said lower end of said stem by a screw and a washer.

8. The seat defined in claim 3 wherein each of said springs is anchored to said support at an outer end by adjustable means for varying the tension of the respective spring.

9. The seat defined in claim 10 wherein said adjustable means includes a respective channel formed in said support, an angle bracket slidably mounted in said channel, a screw engaging said angle bracket and threaded means engaging said screw whereby rotation of said screw displaces said bracket.

10. The seat defined in claim 9 wherein each of said channels is formed with a shoulder defined between a pair of side walls and engaging the respective angle bracket to prevent rotation thereof.

11. A seat comprising:

a hollow base formed with a ball-joint socket at an upwardly extending portion thereof;

a post extending generally upwardly therefrom and formed with a ball received in said socket, said ball and said socket forming a ball joint enabling tilting movement of seat position on said bias;

a seating surface formed on said post at the upper end thereof;

a transverse pin on a stem projecting to opposite sides thereof below said socket, said socket being formed with a slot adapted to clear said pin and enable withdrawal of said ball from said socket, said post being formed with said stem extending below said ball into said base and carrying said pin, said stem having a lower end;

a retaining disk detachably mounted on said lower end of said stem by a screw and a washer; and a star-like array of tension springs angularly spaced about said disk, each of said springs engaging said disk with one end of the spring and having another end for anchoring to said base for resisting tilting movement of said post and biasing same into a normal generally upright position, each of said springs is anchored to said base at the respective other end by adjustable means for varying the tension of the respective spring, said adjustable means including:

a respective channel formed in said base; and an angle bracket slidably mounted in said channel and engaging the respective other end of a respective spring, a screw engaging said angle bracket; and threaded means engaging said screw whereby rotation of said screw displaces the respective bracket, each of said channels being formed with a shoulder defined between a pair of said walls end engaging the respective angle bracket to prevent rotation thereof.

* * * * *